US005205638A

United States Patent [19]

Squitieri

[11] Patent Number: 5,205,638

[45] Date of Patent: Apr. 27, 1993

[54] LIGHTED MERCHANDISE SHELVES

[75] Inventor: Anthony C. Squitieri, Norwalk, Conn.

[73] Assignee: Mechtronics Corporation, Stamford, Conn.

[21] Appl. No.: 921,218

[22] Filed: Jul. 29, 1992

[51] Int. Cl.[5] ..... A47F 11/10

[52] U.S. Cl. ..... 362/125; 362/133; 362/219; 108/23; 312/223.5

[58] Field of Search ..... 362/125, 133, 134, 127, 362/217, 219, 812; 108/23; 312/223.5

[56] References Cited

U.S. PATENT DOCUMENTS

| | | | |
|---|---|---|---|
| 1,928,151 | 9/1933 | Gouldman | 108/23 |
| 2,999,599 | 9/1961 | Jentzen | 108/23 |
| 3,886,348 | 5/1975 | Jonathan | 362/127 |
| 4,164,009 | 8/1979 | Maguire, Jr. et al. | 362/127 |
| 4,689,726 | 8/1987 | Kretzschmar | 362/127 |

FOREIGN PATENT DOCUMENTS

| | | | |
|---|---|---|---|
| 171857 | 2/1935 | France | 362/125 |
| 2133196 | 7/1984 | United Kingdom | 312/223.5 |

*Primary Examiner*—James C. Yeung
*Attorney, Agent, or Firm*—Haynes N. Johnson

[57] ABSTRACT

A shelving bank formed of a plurality of shelving units, wherein the line of juncture between the shelving units may be substantially concealed. The shelving bank includes at least two shelving units, each shelving unit having a plurality of shelves, the shelving units being joined together with the shelves in adjacent shelving units being in smooth abutting relationship, so that boxes of merchandise can be placed over the areas of the abutting relationship. Light plenums under the shelves, each light plenum extending the length of its respective the shelf, so that light plenums of adjacent the shelving units are adjacent to one another and abut one another. Light panels mounted along the front of the light plenums, and the mounting means of adjacent plenums providing for the light panels to bridge the point of abutment of the light plenums, so that the line of juncture between adjacent shelving units is substantially concealed.

7 Claims, 4 Drawing Sheets

LIGHTED MERCHANDISE SHELVES

FIELD OF THE INVENTION

This invention relates to the field of display shelves for use by retailers to hold merchandise for sale. In particular, it relates to shelves which illuminate the goods and also illuminate back-lighted panels used for describing the goods.

BACKGROUND OF THE INVENTION

Merchandise shelving is old, as is shelving which has means for illuminating the goods and/or display panels. However, the shelves are usually made in units of discreet lengths which can be extended by adding another similar bank of shelving. This results in a joint between the units which detracts from their appearance. In my shelving, units can be extended with much of the joint not showing.

BRIEF SUMMARY OF THE INVENTION

Multiple shelves, one above the other, are cantilevered out from rear vertical uprights, with the shelves rising as they come forward. The front edge of a shelf has a light plenum extending below it, holding a fluorescent bulb. The bulb serves to illuminate product advertising panels located just below the edge and to illuminate goods on the shelf below.

Shelf units are often modular and can be added to one another, increasing total shelf length. In my invention, however, the joints between the sections will hardly, if at all, be seen. The joints are not visible because the lighted front panels can extend across the joint, covering it; and the light plenums are continuous from section to section, with no dividing walls (end caps) between them, so the light remains uniform. End caps are used only at the outer ends of shelves. Likewise, the goods are held in boxes or modular trays which have a complementary fit with the shelves and their backs. The backs of the trays can extend across the separation line between units, further disguising it. Since, as stated above, the shelves are tilted backwardly, the trays will be stable and remain in place.

The units are wired with an electric socket at each end of each light plenum, the sockets being interconnected in parallel. They are also connected in parallel to an electric cord with a plug at its end, the cord coming from the center of the back wall of the plenum and being long enough to extend to the nearest base plug of the adjacent shelf. Thus, a series of units of shelving can be interconnected; and power is supplied to the unit by having the cord at one end plugged into a live socket.

DETAILED DESCRIPTION OF THE INVENTION

Figure 1:
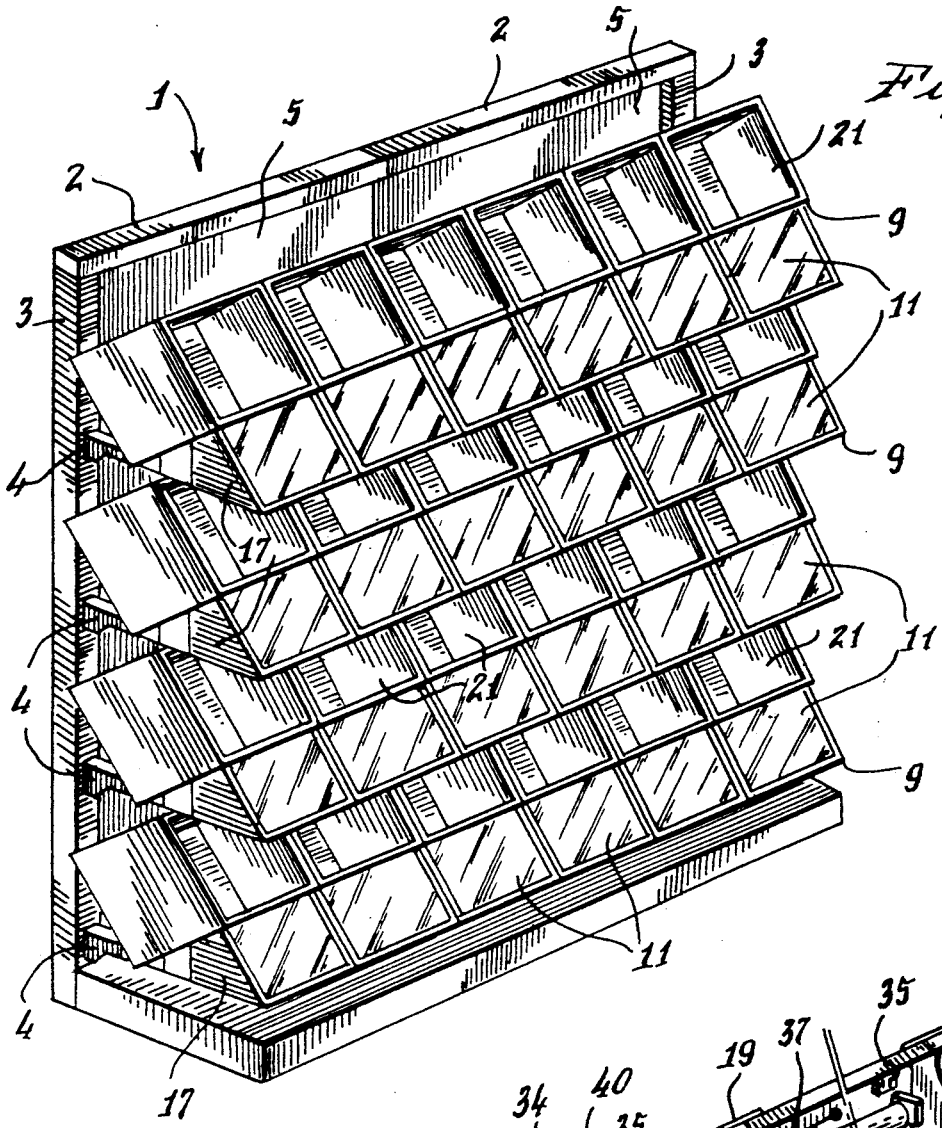
FIG. 1 is a perspective view of two units of shelves being used together. It will be noted that the joint between them is visible only at the very top and at the floor.
Figure 2:
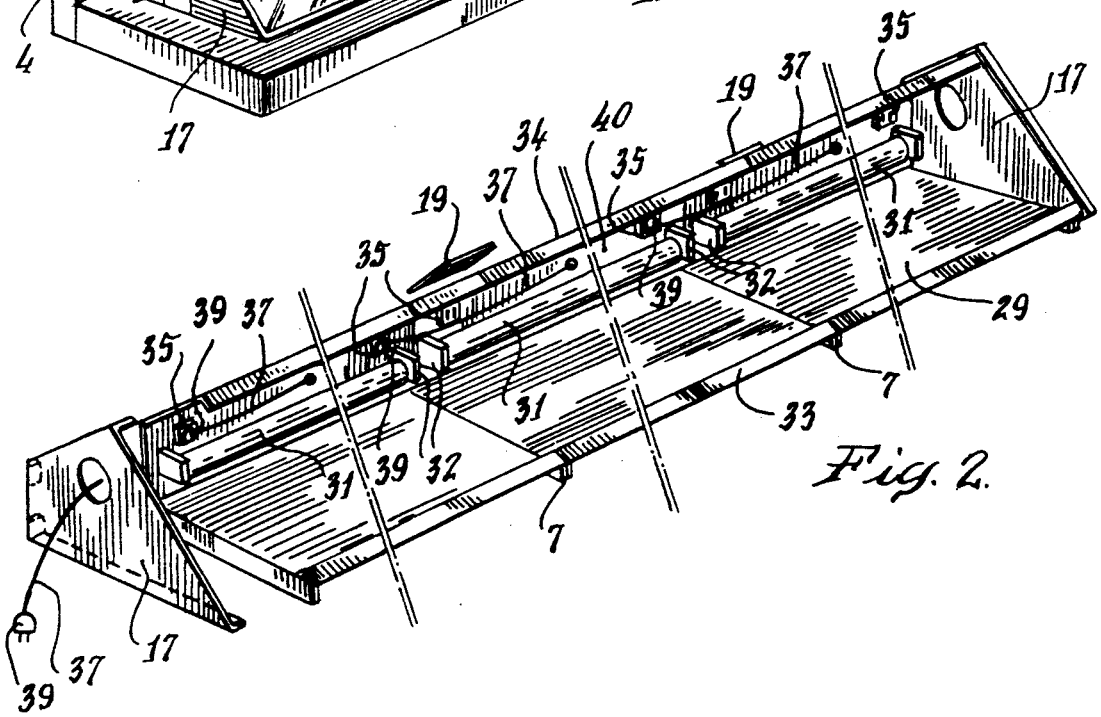
FIG. 2 is a perspective view, partially exploded, of three abutting light plenums for one row of shelves, with their front panels removed.
Figure 3:
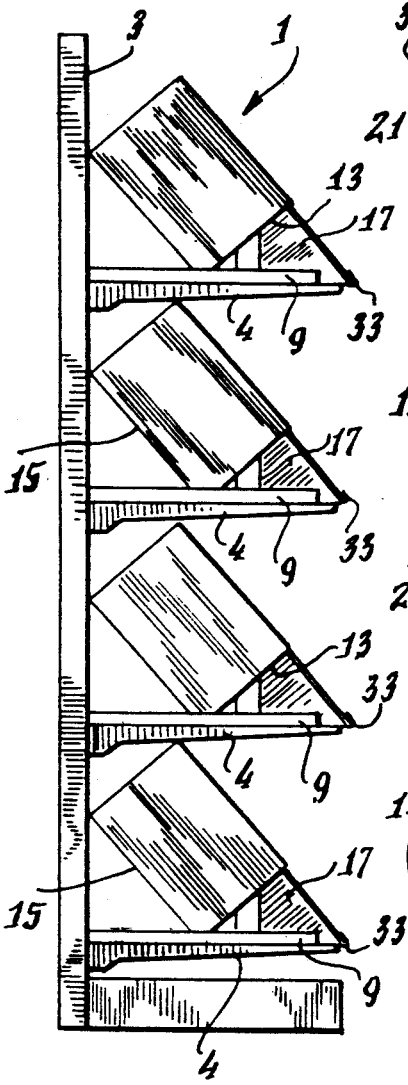
FIG. 3 is an elevation of the end of one bank of shelves.
Figure 4:
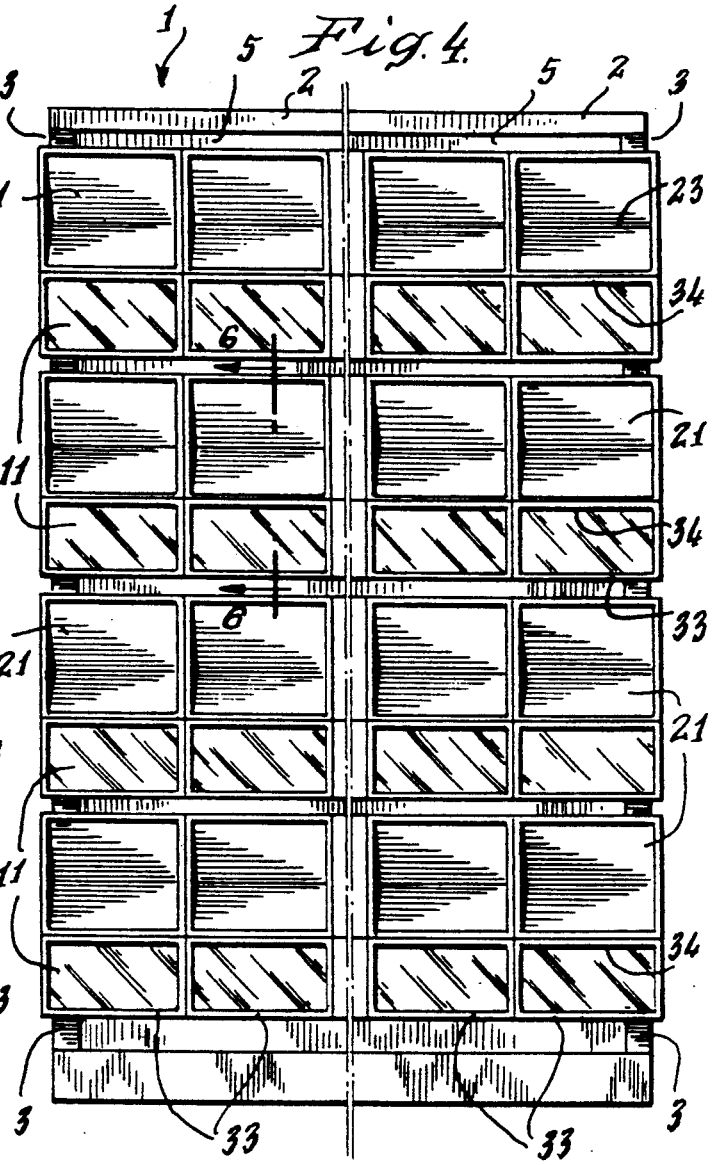
FIG. 4 is a front elevation of the shelves.
Figure 5:
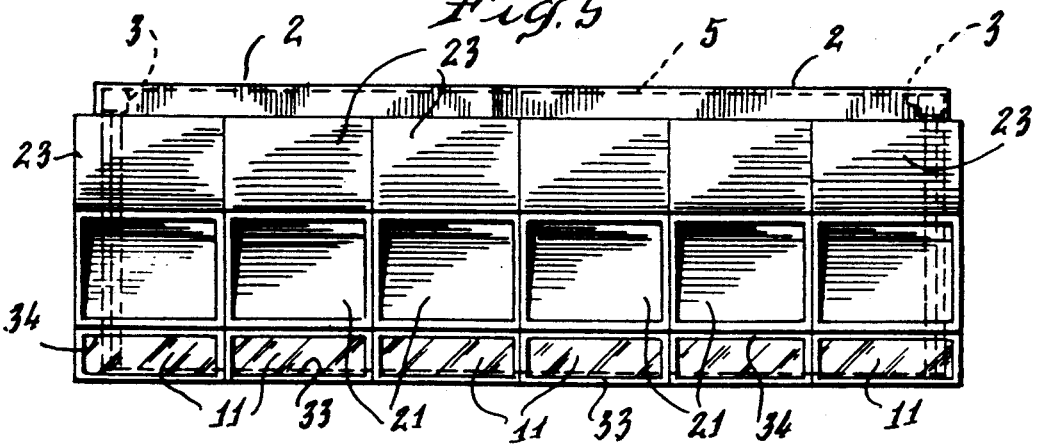
FIG. 5 is a top plan view of the shelves.

An assembled bank 1 of shelves is shown in FIG. 1; and, in this instance, two units 2 have been joined at joint 7 by joiner plate 19. Each unit includes uprights 3 with cantilevered shelf supports 4 (FIG. 6) that are attached to the uprights with hook hangers 6, and a back 5 joining the uprights. A bank of shelves can include one, two, or more units 2, depending upon the desired length. Each unit in the bank should have the same number of shelves at corresponding heights.

The shelves 9 are at an angle in order to hold the merchandise in position, that is, the support member 13 slopes downwardly from front to back. The back 15 of the shelf is at an angle to the support member 13, preferably ninety degrees, so that the support member 13 and the back 15 can receive an open box or tray 21 holding the merchandise to be displayed. It will be noted that the support members and backs of two adjacent units 2 meet flush with one another, with no end pieces or other obstructions between them. Thus, a box 21 can fit over the point of joinder of two units and, so, hide it.

Figure 6:
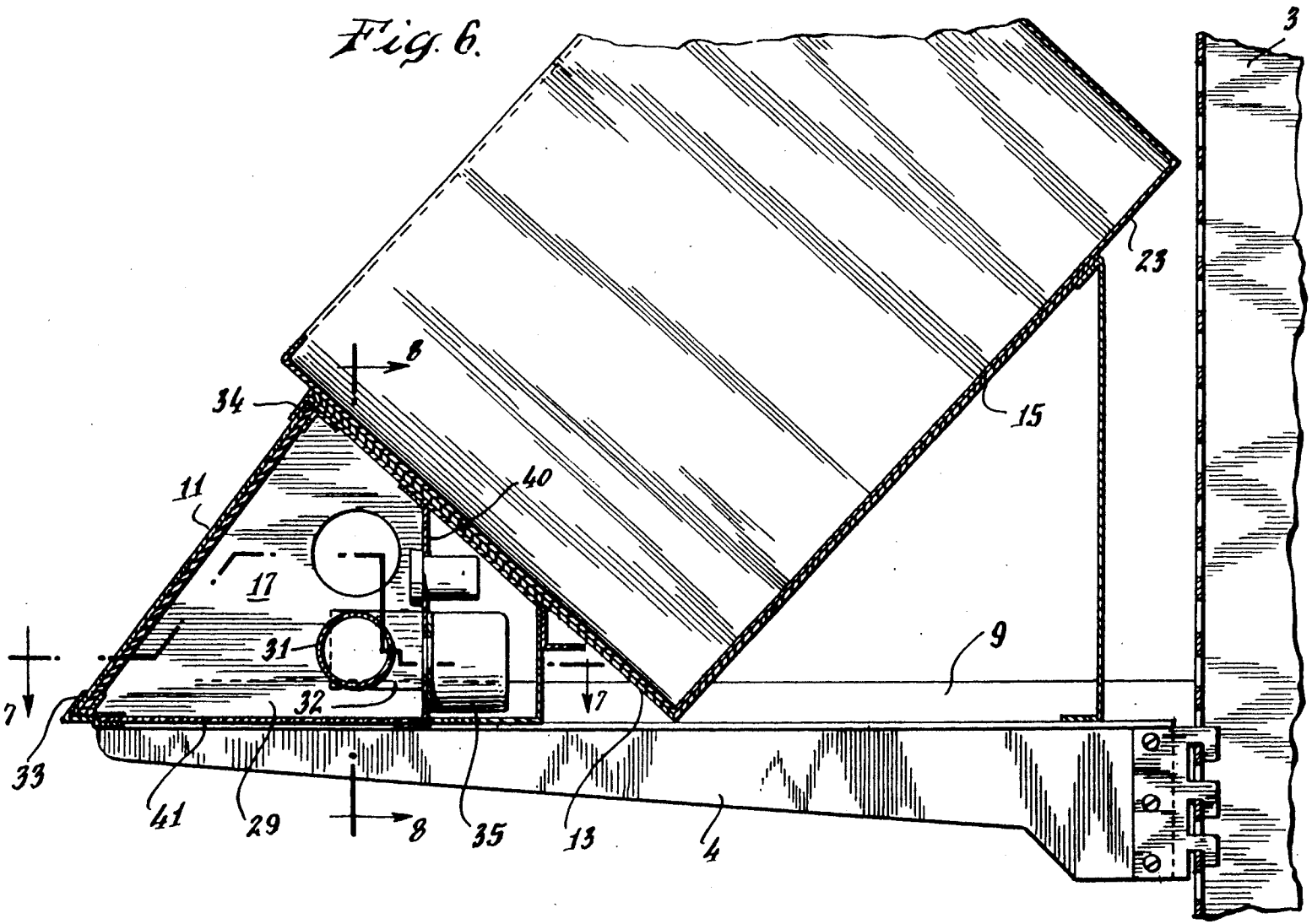
FIG. 6 is a section taken on line 6—6 of FIG. 4.
Figure 7:
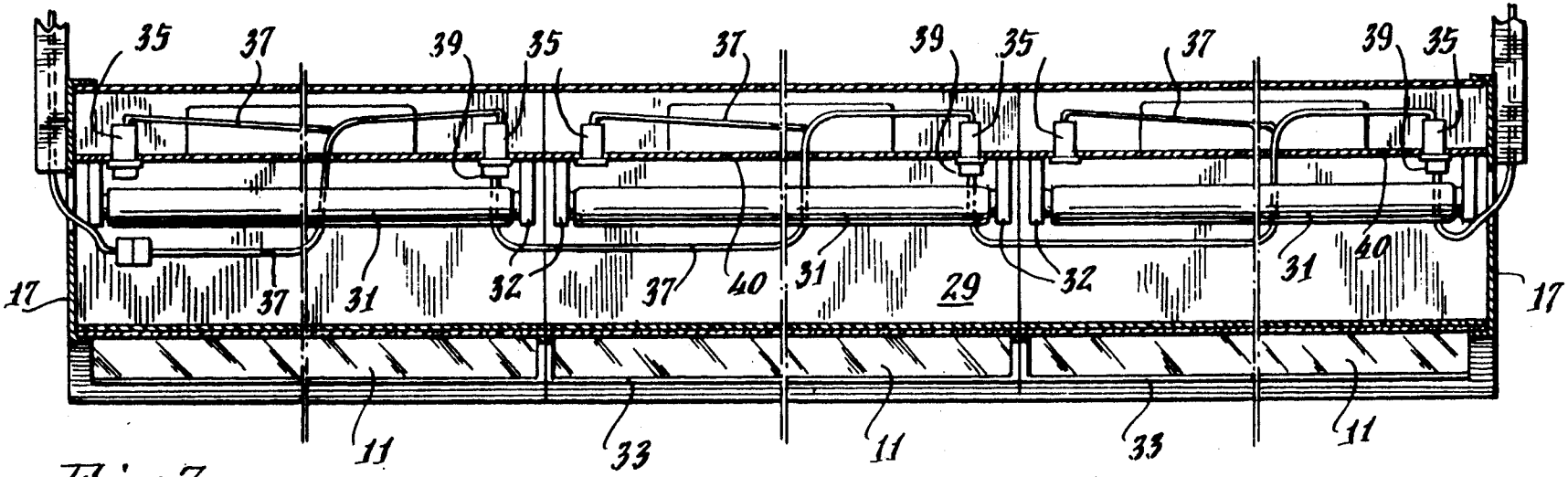
FIG. 7 is a section taken on line 7—7 of FIG. 6.
Figure 8:
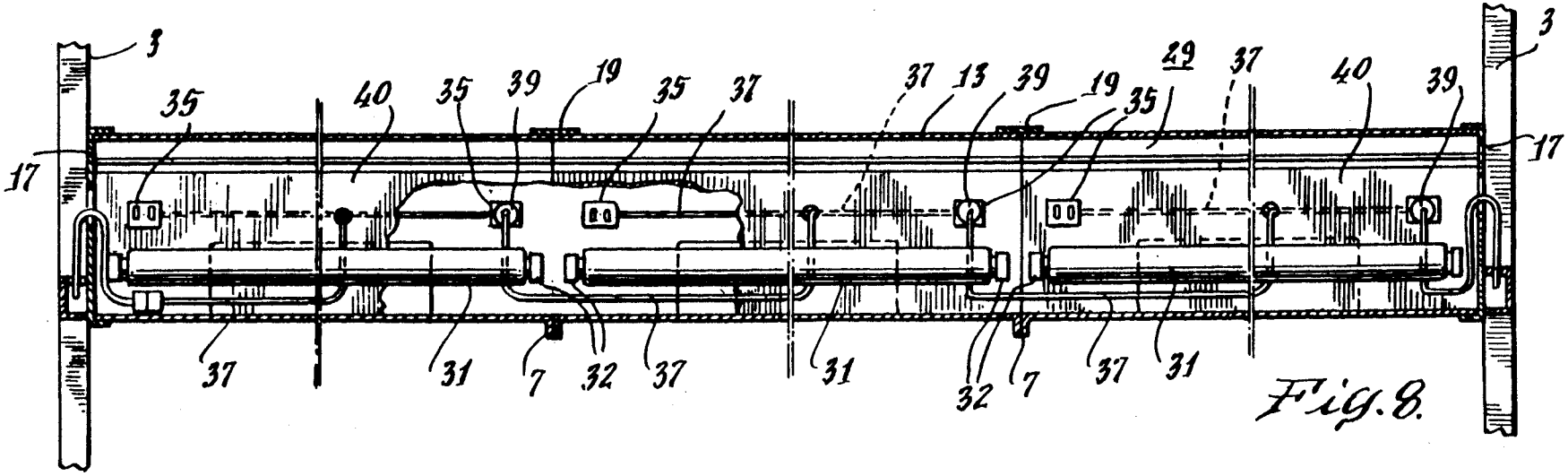
FIG. 8 is a section taken on line 8—8 of FIG. 6.

A light plenum 29 is fitted underneath the support member 13 and is essentially triangular in cross-section. The plenum has a front panel 11, for illumination from the rear, which can describe the merchandise, provided pricing information, etc. Panel 11 is positioned at an angle immediately below tilted support member 13 and is held in position by bottom track 33 and upper track 34 (FIG. 6). The plenum also has a bottom window 41, so that light from the plenum 29 can illuminate goods displayed on the shelf 9 below it. As with the shelves, the light plenums of two adjacent units are flush with one another with no end pieces, caps, or other obstructions between them, except that end caps 17 are mounted at the two ends of a shelf in the bank, as a light closure. The result is that lighted panels 11 and bottom windows 41 can abut tightly and the panels themselves can bridge the point of joinder between two individual units 2, again serving to conceal the joint.

A light plenum 29 is mounted beneath each shelf 9 of a unit, though usually the bottom plenum will have an opaque panel replacing the bottom window 41. Each plenum contains a fluorescent bulb 31, running the length of the plenum, mounted in fixture 32, and the necessary electrical wiring. The wiring includes an electrical outlet 35 adjacent each end and an electric cord 37, with plug 39, extending from the center of the back wall 40 of the plenum. Cord 37 is long enough to reach the nearest outlet 35 in the adjacent light plenum 29.

In each plenum the two electrical outlets 35 and the cord 37 are wired in parallel with one another and with the fixture 32 for bulb 31. Accordingly, to wire the plenums of one shelf formed of several units, one connects the cord 37 of the plenum at one end or the other (the first plenum) to an electrical source. The cord 37 of the adjacent plenum (the second plenum) is then plugged into the outlet 35 of the first, end plenum. The cord 37 of the next plenum (third plenum) is plugged into the outlet 35 of the second plenum, and so on for each pair of adjacent plenums until all have been interconnected. The same procedure is used for each shelf 9 of the bank of shelves 1. The source of electricity for each of the shelves may, if desired, be brought to the shelves by wiring carried in uprights 3.

I claim:

1. A shelving bank formed of a plurality of shelving units wherein the line of juncture between the shelving units is substantially concealed, said shelving bank including at least two shelving units, each said shelving unit including a plurality of shelves, said shelving units being joined together with said shelves in adjacent said shelving units being in smooth abutting relationship, whereby boxes of merchandise can be placed over the areas of said abutting relationship, light plenums under at least one of said shelves of said shelving units, each, said light plenum extending the length of its respective said shelf and having a front and a bottom, so that light plenums of adjacent said shelving units are adjacent to one another and abut one another, each said light plenum including a light source extending for substantially the length of said light plenum, light panels, mounting means to receive said light panels along the front of said light plenums, and said mounting means of adjacent said plenums providing for said light panels to bridge the point of abutment of said light plenums, whereby the line of juncture between adjacent said shelving units is substantially concealed.

2. A shelving bank as set forth in claim 1 including a window in the bottom of said light plenums, whereby merchandise displayed on a shelf below can be illuminated.

3. A shelving bank as set forth in claim 1 in which said light sources are electrically interconnected.

4. A shelving bank as set forth in claim 3 in which said electrical interconnection includes an electric outlet adjacent each end of said light plenum and an electrical cord running from the center of said light plenum, said electric outlets and said electric cord being wired in parallel, whereby said cord of one said light plenum can be connected to a said electric socket in an adjacent said light plenum.

5. A shelving bank as set forth in claim 1 including boxes positioned on said shelves and covering the areas in which said shelving units are in abutting relationship.

6. A shelving bank as set forth in claim 1 including end caps over the outer, exposed ends of said light plenums, but not over abbutting said light plenums.

7. A shelving bank including at least two shelving units, each said shelving unit including a plurality of shelves, each said shelving unit containing the same number of said shelves with said shelves being of corresponding heights, said shelving units being joined together end to end with said shelves in adjacent said shelving units being in smooth abutting relationship, boxes of merchandise over the areas of said abutting relationship, light plenums under said shelves, each said light plenum extending the length of its respective said shelf, so that light plenums of adjacent said shelving units are adjacent to one another and abut one another, each said light plenum including a light source, light panels, mounting means to receive said light panels along the front of said light plenums, and said mounting means of adjacent said plenums providing for said light panels to bridge the point of abutment of said light plenums, whereby the line of juncture between adjacent said shelving units is substantially concealed.

* * * * *